US008596615B2

(12) United States Patent
Kommer

(10) Patent No.: US 8,596,615 B2
(45) Date of Patent: Dec. 3, 2013

(54) LIFTING OR LOCKING SYSTEM AND METHOD

(71) Applicant: GB II Corporation, Tualatin, OR (US)

(72) Inventor: Russ Kommer, Fargo, ND (US)

(73) Assignee: GB II Corporation, Tualatin, OR (US)

( * ) Notice: Subject to any disclaimer, the term of this patent is extended or adjusted under 35 U.S.C. 154(b) by 0 days.

(21) Appl. No.: 13/691,335

(22) Filed: Nov. 30, 2012

(65) Prior Publication Data

US 2013/0099186 A1 Apr. 25, 2013

Related U.S. Application Data

(63) Continuation of application No. 13/587,584, filed on Aug. 16, 2012.

(60) Provisional application No. 61/525,554, filed on Aug. 19, 2011.

(51) Int. Cl.
*B66D 3/04* (2006.01)

(52) U.S. Cl.
USPC ..... 254/391; 254/408

(58) Field of Classification Search
USPC ..... 254/394, 391, 408, 393, 397, 398, 399
See application file for complete search history.

(56) References Cited

U.S. PATENT DOCUMENTS

| | | | | |
|---|---|---|---|---|
| 587,976 | A | 8/1897 | Kirkman | |
| 668,594 | A | 2/1901 | Walton | |
| 711,570 | A | 10/1902 | Hover | |
| 718,447 | A | 1/1903 | Frampton | |
| 733,527 | A | 7/1903 | Wuest | |
| 756,747 | A | 4/1904 | Walton | |
| 936,900 | A | 10/1909 | Hover et al. | |
| 3,756,565 | A * | 9/1973 | Sakai | 254/391 |
| 3,944,186 | A | 3/1976 | Einhorn et al. | |
| 4,079,916 | A | 3/1978 | Einhorn et al. | |
| 4,466,599 | A * | 8/1984 | Singer | 254/391 |
| 5,092,309 | A | 3/1992 | Beaton | |
| 6,112,732 | A * | 9/2000 | Larson | 124/25.6 |
| 6,182,946 | B1 * | 2/2001 | Rutherford | 254/391 |
| 6,685,171 | B2 * | 2/2004 | Lob et al. | 254/391 |
| 7,419,138 | B1 | 9/2008 | Mauthner | |
| 7,658,264 | B2 * | 2/2010 | Mauthner | 182/5 |
| 2008/0203371 | A1 * | 8/2008 | Mauthner | 254/391 |

OTHER PUBLICATIONS http://www.hopkinsfittingts.co.uk/p0_4705/hop1076.html#detail, "Special Pulleys, HOP1076, Guide Pulley with jam cleat," 2 pages, printed Sep. 2012.

* cited by examiner

*Primary Examiner* — Emmanuel M Marcelo
(74) *Attorney, Agent, or Firm* — Klarquist Sparkman, LLP

(57) ABSTRACT

A lifting mechanism or locking mechanism includes a housing, an axle attached to the housing, and an element including a cam surface mounted for rotation on the axle. The distance between the cam surface and the housing changes between a maximum clearance distance and a minimum clearance distance as the element rotates about the axle. The lifting mechanism also includes a line which can be moved between a first position over the cam surface and a second position.

18 Claims, 8 Drawing Sheets

LIFTING OR LOCKING SYSTEM AND METHOD

CROSS REFERENCE TO RELATED APPLICATION

This application is a continuation of U.S. patent application Ser. No. 13/587,584, filed Aug. 16, 2012, which claims the benefit of U.S. Provisional Application No. 61/525,554, filed Aug. 19, 2011, both of which applications are incorporated herein by reference.

FIELD

Various embodiments described herein relate to a lifting or locking system and a method.

BACKGROUND

Lifting systems are needed for many applications. Outdoorsmen frequently use lifting systems. Hunters lift deer and other big game as part of the butchering process. Campers that camp in areas with bears, hoist a bear bag with all their smellables from a high branch on a tree. This prevents bears from coming into camp. There are other uses of lifting systems such as for hoisting bikes or canoes up to the ceiling of a garage for storage purposes. These are but a few example uses.

Currently, ropes must be tied off while the heavy load is held up. For example, when hoisting a bear bag, the rope is wrapped around the tree to slow or prevent slippage. The rope is then tied off to another tree while still being held taut. It is difficult to hold a rope taut while tying it off. If the job is not done correctly, there are consequences. The load or object being hoisted may come crashing down which endangers others and which can damage the object being hoisted.

SUMMARY

The invention includes a lifting or locking mechanism that includes a housing, an axle attached to the housing, and an element including a cam surface mounted for rotation on the axle. The distance between the cam surface and the housing changes between a maximum clearance distance and a minimum clearance distance as the element rotates about the axle. The lifting or locking mechanism also includes a line which can be moved between a first position over the cam surface and a second position. In one embodiment, the cam surface includes a surface treatment for increasing an amount of friction at the cam surface. In another embodiment, the cam surface is associated with a cam and in still another embodiment, the cam surface is associated with a round element that includes an off center opening. The round element is rotatably mounted to the axis via the off center opening. In still a further embodiment, the lifting mechanism also includes a sheave mounted to the axle. The cam surface and the sheave can be formed from a single piece of material. The cam surface and the sheave can also be separate elements. In one embodiment, the line is in the second position when it is positioned within the sheave. The lifting or locking mechanism, in one embodiment, is made from a metal.

DETAILED DESCRIPTION

Figure 1:
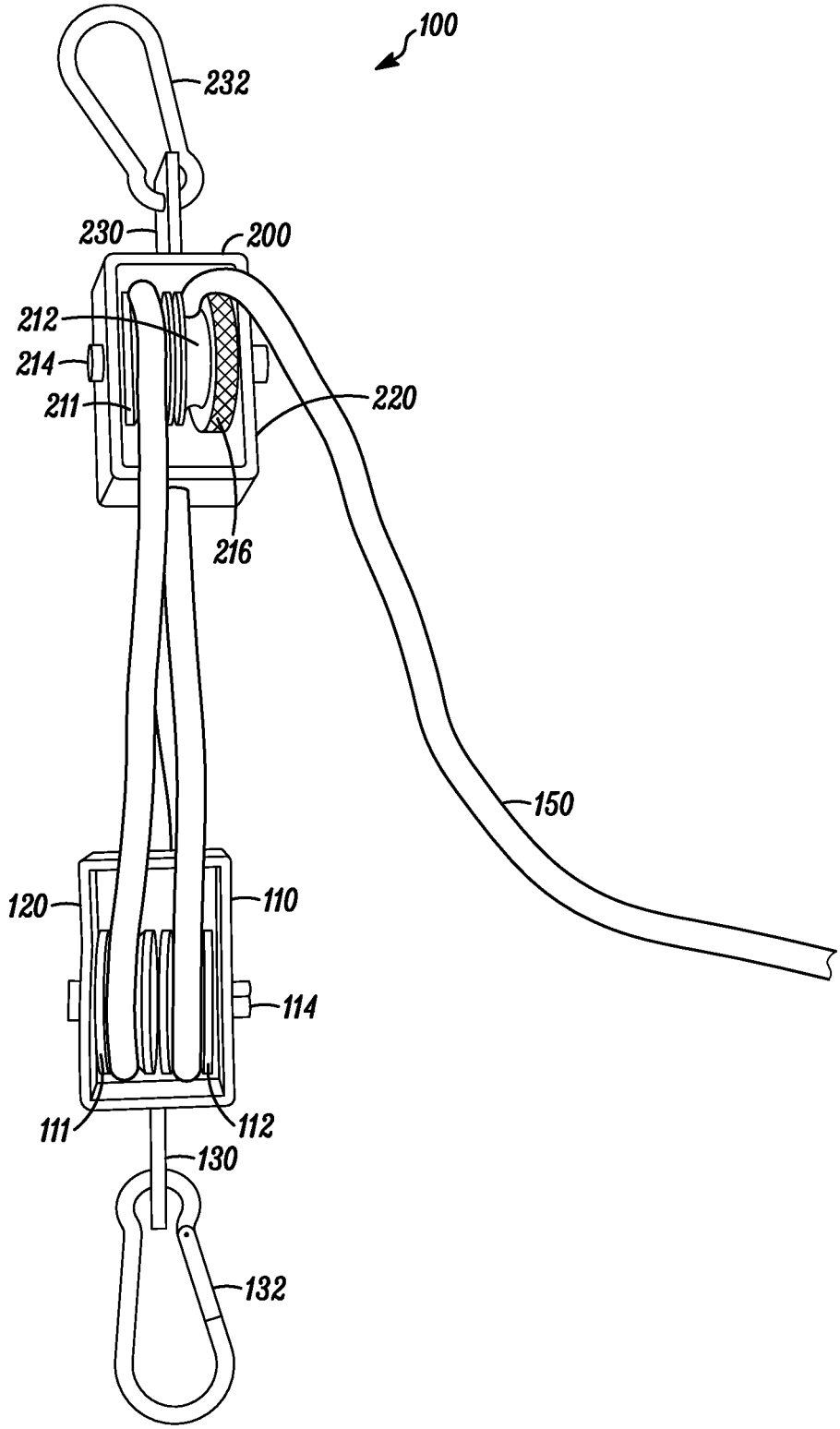
FIG. 1 is a perspective view of a lift system in use, according to an example embodiment.

FIG. 1 is a top view of a block and tackle 100 that includes the invention, according to an example embodiment. The block and tackle 100 includes a moving block 110 and a fixed block 200. The moving block 110 includes a set of pulleys 111, 112 (also known as sheaves) rotatably mounted on a single axle 114. The axle 114 is mounted to a moving block housing 120. The moving block housing also includes an attachment point 130. In the example shown, a carbineer 132 is attached to the attachment point 130. A load or item that is to be moved is attached to the carbineer 132.

The fixed block 200 also includes a set of pulleys 211, 212 which are rotatably mounted to an axle 214. The axle 214 is attached to a fixed block housing 220. The pulley 212 includes a widened edge 216 which, when assembled, is placed close to the side of the fixed block housing 220. In the embodiment shown, the widened edge 216 of the pulley or sheave 212 is knurled so as to provide additional friction on the widened edge 216. The fixed block housing 220 is slightly wider than the moving block housing 120 so as to accommodate the widened edge 216 of the pulley 212. The fixed block housing 220 also has an attachment point 230. A carbineer 232 is attached to the fixed block attachment point. One end of a line 150 is attached to the fixed block housing 220. The line is threaded though the pulley 111, the pulley 211, the pulley 112, and the pulley 212. A free end of the line 150 leaves the pulley or sheave 212. A pulling force can be placed on the line 150 so as to move the moving block 110 with respect to the fixed block 200. The line 150 substantially completes the block and tackle 110.

Figure 2A:
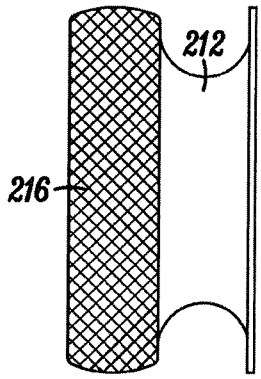
FIG. 2A shows a top view of the pulley or sheave with the widened end that includes the knurled surface, according to an example embodiment.
Figure 2B:
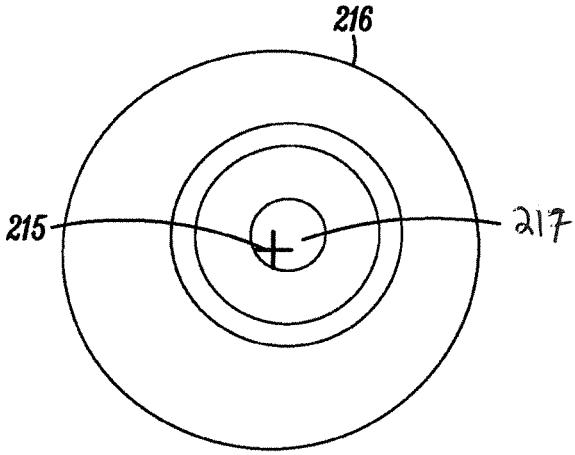
FIG. 2B shows a side view of the pulley or sheave, according to an example embodiment.

The pulley 212 or set of pulleys 211, 212 in the above block and tackle 100 are modified. The pulley 212 includes the widened edge 216 with the knurled portion 216. FIG. 2A shows a top view of the pulley or sheave 212 with the widened end 216 that includes the knurled surface, according to an example embodiment. FIG. 2B shows a side view of the pulley or sheave 212, according to an example embodiment. FIG. 2B shows that the opening 217 for the axle is offset or off center from a central axis 215 of the pulley 212. The opening 217 is eccentric. As the pulley 212 rotates about the axle 214, the distance between the perimeter of the sheave or pulley 212 and the housing 230 varies. The amount of variance is continuous and equates to simple harmonic motion.

Figure 3A:
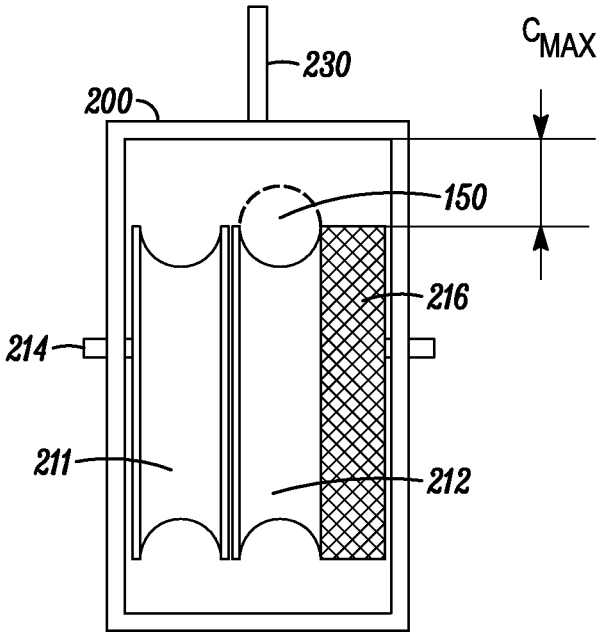
FIG. 3A is a close up view of the fixed block and more particularly a first position of the pulley or sheave with respect to the housing of the fixed block, according to an example embodiment.
Figure 3B:
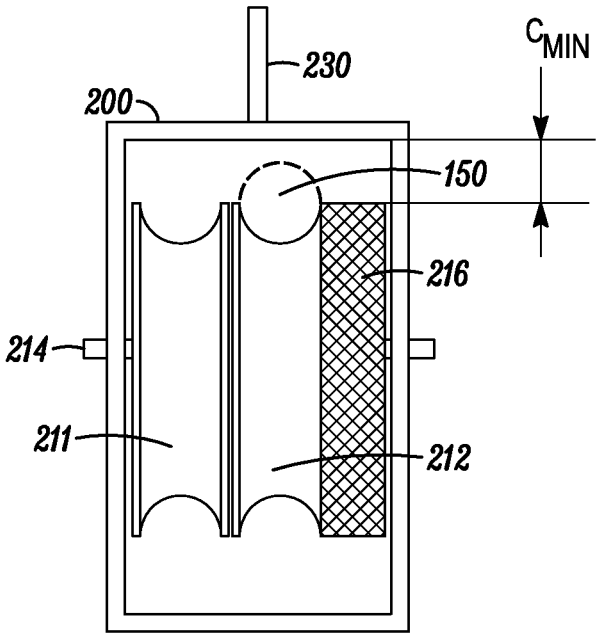
FIG. 3B is a close up view of the fixed block and more particularly a second position of the pulley or sheave with respect to the housing of the fixed block, according to an example embodiment.

FIGS. 3A and 3B are close up views of the fixed block 200 and more particularly the pulley or sheave 212 and the fixed block 200, according to an example embodiment. The axis 214 on which the sheave or pulley 212 rotates is offset from the center of the pulley or sheave 212. FIG. 3A shows the maximum distance between the sheave or pulley 212 and the fixed block 200 as the pulley 212 rotates about the axle 214, according to an example embodiment. This clearance distance is maximum, $C_{max}$, occurs once every rotation of the sheave 212. It should be noted that the clearance distance is also at its maximum with respect to the widened surface 216 of the sheave 212. In this particular embodiment, the sheave or pulley 211 has an offset opening similarly positioned to the offset opening of the sheave or pulley 212. As a result, it too is at a maximum clearance distance, $C_{max}$, from the fixed housing 200. It should be understood that in another embodiment, the sheave 211 could be provided with a center opening on which the sheave or pulley 211 would rotate.

FIG. 3B shows the minimum clearance $C_{min}$, distance between the sheave or pulley 212 and the fixed block 200. This also occurs once during the rotation of the pulley or sheave 212. This position occurs after about half a rotation or after the sheave or pulley 212 rotates through about 180 degrees of rotation. The widened edge 216 of the pulley or sheave is at the periphery of the sheave or pulley and is also at a minimum clearance distance, $C_{min}$. It should be noted that the cord or line 150 has a diameter, d, which is greater than the minimum clearance distance, $C_{min}$. The sheave or pulley 211 has an opening that is offset by about the same distance as the sheave 212 so it too is at the minimum clearance distance.

When the pulleys 211, 212 are offset the motion corresponds to a simple harmonic motion that is related to the offset of the pulleys 211, 212 from rotation about the center of the pulley 212 or pulleys 211, 212. As the pulley rotates it passes a maximum clearance distance, $C_{max}$, and a minimum clearance distance $C_{min}$, between the pulley 212 or pulleys 211, 212 and the housing 200. The cord or line 150 has a diameter, d, which is larger than the minimum clearance distance $C_{min}$.

Figure 4:
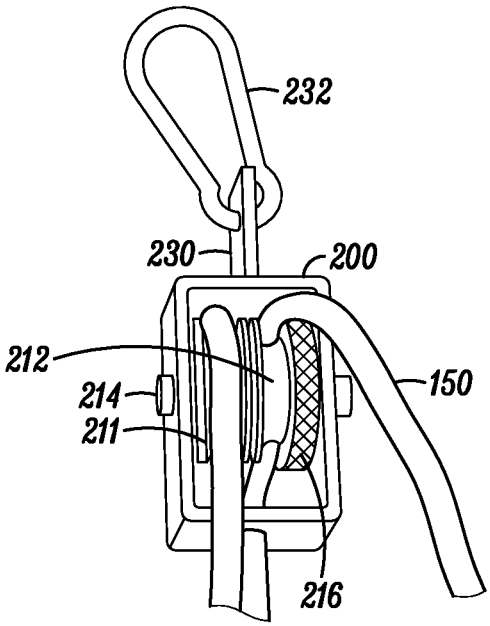
FIG. 4 shows the fixed block when the cord or line is pinched or held between the fixed housing and the widened surface, according to an example embodiment.

FIG. 4 shows the fixed block 200 when the cord or line 150 is pinched or held between the fixed housing 200 and the widened surface 216, according to an example embodiment. The axel 214 is placed so that the sheave or pulley 212 can rotate freely when the cord or line 150 is positioned within the sheave 212 and so that the dimension $C_{min}$ is less than the cross-sectional diameter of the cord or line 150. In operation, the cord or line 150 is used to hoist a load as it would be in a block and tackle, such as block and tackle 100. When the load is at a desired position the user merely moves the cord or line to the side of the sheave or pulley 212. The cord or line 150 is positioned so that it crosses the widened portion 216 of the pulley 212. The load is then released or let down slightly with the cord or line 150. The cord or line 150 has a diameter which is larger than $C_{min}$ (shown in FIG. 3B) so the cord is caught or pinched between the housing 200 of the fixed block and the widened edge 216. The knurling on the widened edge 216 increases the friction between the cord or line 150 and the widened edge 216. This prevents or substantially curtails the cord or line 150 from slipping over the widened edge 216. When the pulley or sheave approaches $C_{min}$ as it rotates, the line 150 is captured between the widened edge 216 and the housing 200. Adding more weight to the load on the moving block 110 results in further wedging the line or cord 150 into the space between the widened edge 216 and the housing 200. When the spacing is correct, the line or cord 150 eventually catches and stops as it is pinched between the widened edge 216 and the top of the housing 200 where $C_{min}$ occurs. When pinched, the load is held in position by the line 150. The line 150 does not move since it is wedged between the widened edge and the housing. To release the line 150, the line is pulled in the other direction away from the widened edge 216 and toward the sheave 212. The free end of the line 150 is pulled and the line 150 is dislodged and repositioned in the sheave or pulley 212. The block and tackle 100 can then be used to move the load.

In one embodiment, the sheaves or pulleys 211, 212 are both off center while the sheaves or pulleys 111, 112 are centered. In still another embodiment, the sheaves or pulleys 111, 112, 211 are all centered and the sheave 212 is off center. When the sheave 212 is off center, the sheave produces an eccentric motion like a cam.

Figure 5A:
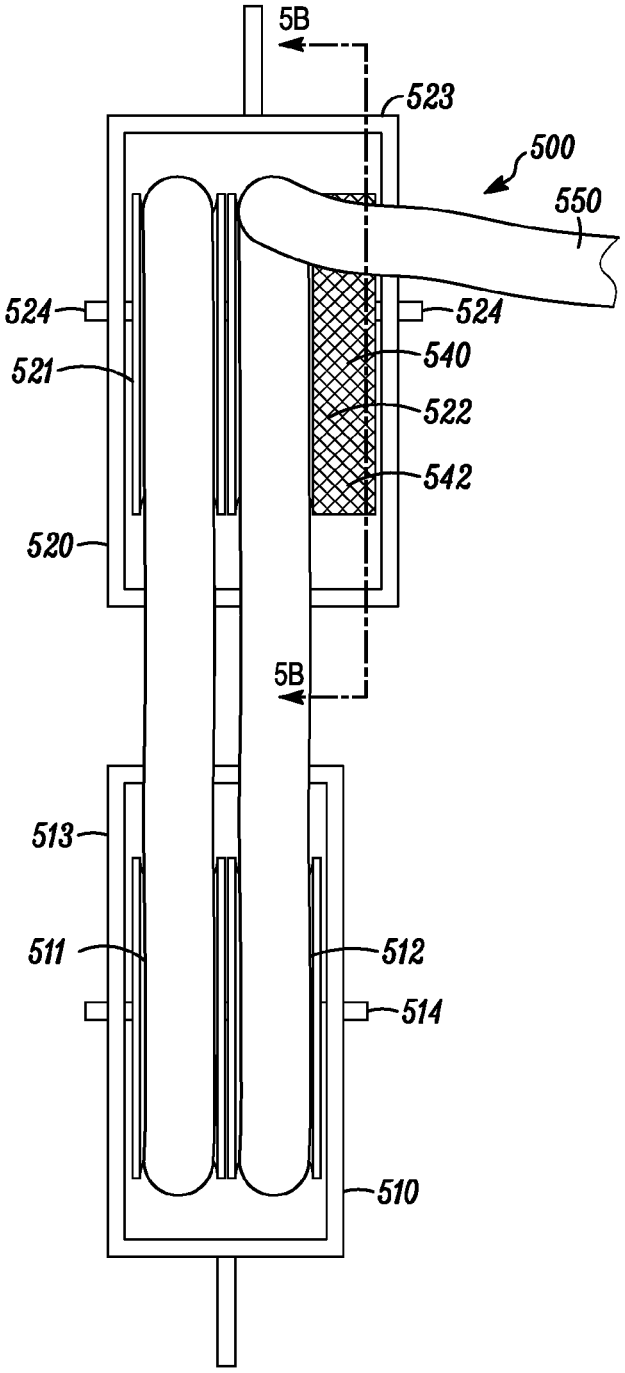
FIG. 5A shows another embodiment of a block and tackle.
Figure 5B:
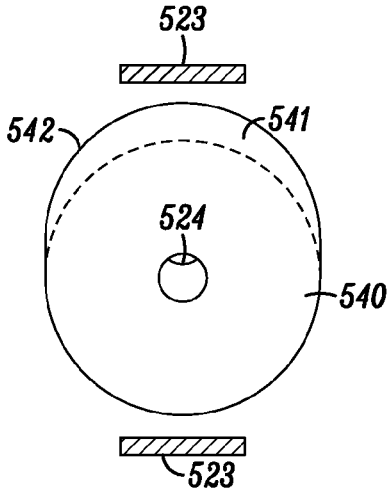
FIG. 5B shows a cross sectional view of the fixed block along line 5B-5B in FIG. 5A, according to an example embodiment.

FIG. 5A shows another embodiment of the block and tackle 500, according to an embodiment of this invention. FIG. 5B shows a cross sectional view of the fixed block along line 5B-5B in FIG. 5A, according to an example embodiment. Referring to both FIGS. 5A and 5B, the block and tackle 500 will be further detailed. The block and tackle 500 includes a moving block 510 that includes a sheave 511 and a sheave 512. The moving block 510 also includes a housing 513. Attached to the housing 513 is an axle 514. The block and tackle 500 also includes a fixed block 520 that includes a sheave 521 and a sheave 522. The fixed block 520 also includes a housing 523. Attached to the housing 523 is an axle 524. The sheaves 511, 512, 521, and 522 all include centered openings on which to rotate. Sheaves 511, 512 rotate on axle 514 of the moving block. Sheaves 521, 522 rotate on axle 524 of the fixed block 520. Also attached to the axle 524 of the fixed block housing 523 is a cam 540. The cam 540 is positioned adjacent the sheave 522. The cam 540 includes a lobe 541 that passes nearer to the housing 523 than the sheave 522 or nearer to the housing 523 than the other parts of the cam 540 as it rotates on axle 524. In one embodiment, the cam is attached to the sheave 522. In another embodiment, the cam 540 is attached to the axle 524. In still another embodiment, the cam 540 is keyed to the axle 524. In still another embodiment, the axle 524 can have a flat portion and the cam 540 can be provided with a set screw to tighten to the flat.

The surface 542 associated with the outer perimeter of the cam 540 can also be treated to increase friction, such as by knurling the surface. The surface 542 can also be treated in other ways to roughen the surface 542 which in turn enhances the gripping ability of the cam 540. The cam 540 can be made of metal or another material. The block and tackle 500 is completed by attaching a line 550 to the fixed block 520 or the moving block 510 and threading the line 550 through the sheave 511, sheave 521, sheave 512 and sheave 522. The free end of the line can be pulled to move a load attached to the moving block 510.

During operation, the cord or line 550 is used to hoist a load as it would be in a block and tackle, such as block and tackle 500. When the load is at a desired position the user merely moves the cord or line to the side of the sheave or pulley 522 to a position crossing the outer surface 542 of the cam 540. The load is then released or let down slightly with the cord or line 550. The cord or line 550 has a diameter which is larger than the minimum distance between the lobe 541 of the cam 540 and the fixed housing 523 so the cord is caught or pinched between the housing 523 of the fixed block 520 and the edge 542 at the outer perimeter of the cam 540. The knurling on the widened edge 542 increases the friction between the cord or line 550 and the edge 542. The cam 540 has a thickness to allow the edge 542 to pinch or grip the line 550. This prevents or substantially curtails the cord or line 550 from slipping over the edge 542. When the cam 540 approaches the minimum clearance point (corresponding to the lobe 541 passing the housing 523) as it rotates, the line 550 is captured between the cam 540 edge 542 and the housing 523. Adding more weight to the load on the moving block 510 results in increased wedging of the line or cord 550 into the space between the surface 542 of the cam 540 and the housing 523. When pinched, the load is held in position by the line 550. The line 550 does not move since it is wedged between the surface 542 and the housing 523. To release the load, the line 550 is pulled in the other direction away from the edge 542 of the cam 540 and toward the sheave 522. The free end of the line 550 is pulled and the line 550 is dislodged and repositioned in the sheave or pulley 522. The block and tackle 500 can then be used to move the load.

In another embodiment, the cam 540 can be replaced with a disk having a opening therein that is off center so that it presents an eccentric motion as it rotates. The perimeter of the disk can be roughened or treated to increase friction. The disk can be attached to sheave 522 or attached to the shaft 524 as discussed above. In short, the eccentric disk would replace the cam 540 with its lobe 541. It could be attached to the shaft or axle 524 in any way, including the ways mentioned above with respect to the cam 540.

Figure 8A:
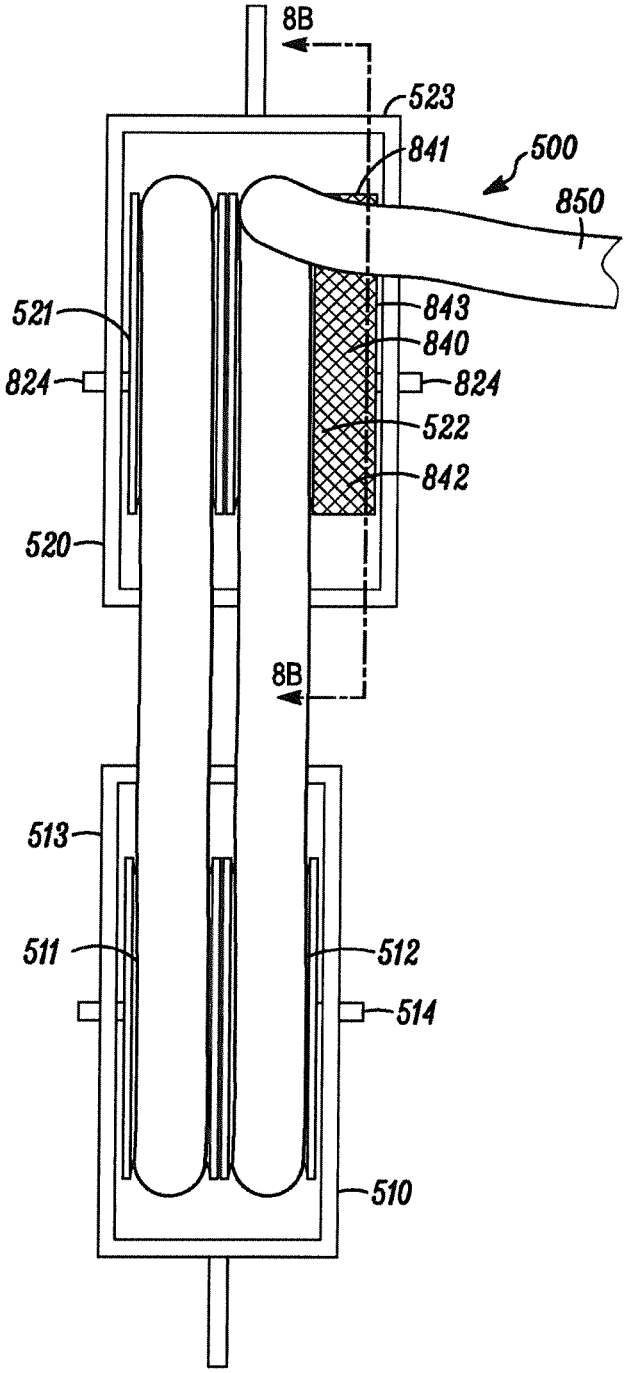
FIG. 8A shows another embodiment of the block and tackle, according to an embodiment of this invention.
Figure 8B:
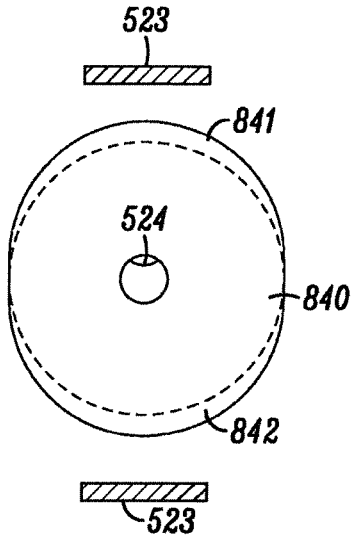
FIG. 8B shows a cross sectional view of the fixed block along line 8B-8B in FIG. 8A, according to an example embodiment.

FIG. 8A shows another embodiment of the block and tackle 800, according to an embodiment of this invention. FIG. 8B shows a cross sectional view of the fixed block along line 8B-8B in FIG. 8A, according to an example embodiment. Referring to both FIGS. 8A and 8B, the block and tackle 800 will be further detailed. The block and tackle 800 is similar to the block and tackle 500 shown in FIGS. 5A and 5B and discussed above. Many of the components of the block and tackle 800 are the same as the block and tackle 800. Rather than describe the entire block and tackle 800 in detail, the different portions of the block and tackle when compared to the block and tackle 500 will be detailed. One difference is that the cam 840 is multi-lobed. In other words, the cam 840 includes two or more lobes. In the embodiment shown, there are two lobes 841 and 842. It should be understood that there may be three lobes, four lobes or even more. The axle 824 can be located substantially equidistant between the lobes, such as lobes 841, 842. In another embodiment, the axle can be located at two different distances from the axle. The cam 840 can have an opening therein so that the cam rotates on the axle. In another embodiment, the axle can be affixed to the cam 840 so that the axle 824 rotates with respect to the opening in the housing of the fixed block.

The surface 843 associated with the outer perimeter of the cam 840 can also be treated to increase friction, such as by knurling the surface. The surface 843 can also be treated in other ways to roughen the surface 543 which in turns enhances the gripping ability of the cam 840. The cam 840 can be made of metal or another material. The block and tackle 800 is completed by attaching a line 850 to the fixed block 520 or the moving block 510 and threading the line 850 through the sheave 511, sheave 521, sheave 512 and sheave 522. The free end of the line can be pulled to move a load attached to the moving block 510.

In operation, the line 850 could catch or be pinched near or at lobe 841 or near or at lobe 842. When the cam is bigger in diameter for heavy duty operation, the line will catch or be pinched within half a rotation. The more lobes in the multi-lobed cam, the less movement needed before the line will catch. Of course, the number of lobes needs to be balanced with the diameter of the cam 840. At some point, the number of lobes becomes too numerous such that the line 850 cannot be moved to a position on the cam surface 843 without being hindered by another lobe.

Figure 9A:
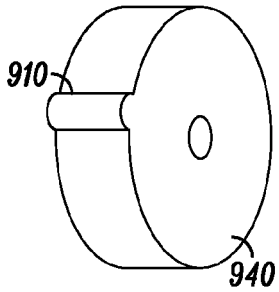
FIG. 9A shows different type of lobe associated with a cam, according to an example embodiment.
Figure 9B:
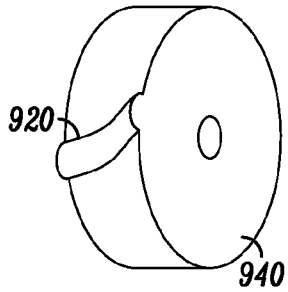
FIG. 9B shows another different type of lobe associated with a cam, according to an example embodiment.

FIGS. 9A and 9B show different type of lobe associated with a cam 940, according to an example embodiment. In FIGS. 9A and 9B, the lobe is a raised feature on a substantially round disk having about the same diameter as the sheaves associated with a block and tackle or a pulley system. FIG. 9A shows a raised feature 910 that traverses the surface of the cam 940. FIG. 9B shows another raised feature 920 that traverses the surface of the cam 940. The raised feature 910, 920 pinches the line between the raised feature 910, 920 and a housing holding the cam 940, when the line is moved to a position on the surface of the cam 940. Of course, a cam 940 can be provided with a plurality of raised features 910, 920.

Figure 10A:
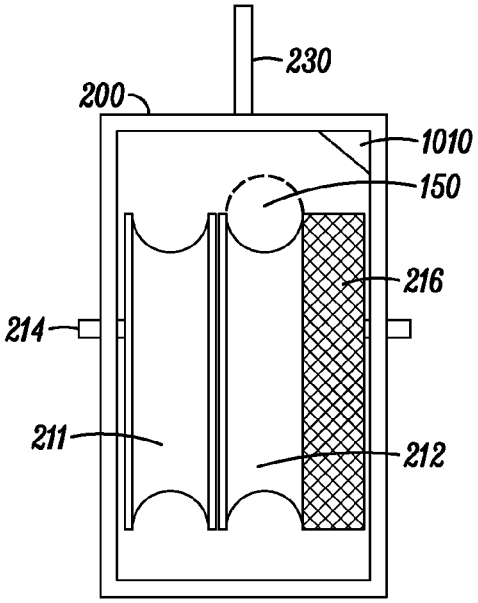
FIG. 10A is a close up view of the fixed block and more particularly the pulley or sheave and the fixed block, according to another example embodiment.
Figure 10B:
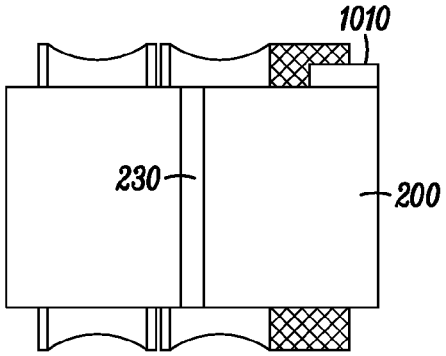
FIG. 10B is a top view of the fixed block shown in FIG. 10A, according to another example embodiment.

FIG. 10A is a close up view of the fixed block 200 and more particularly the pulley or sheave 212 and the fixed block 200, according to another example embodiment. FIG. 10B is a top view of the fixed block 200 shown in FIG. 10A. The axis 214 on which the sheave or pulley 212 rotates is offset from the center of the pulley or sheave 212. The fixed block shown in FIGS. 10A and 10B is similar to the fixed block 200 shown in FIGS. 3A and 3B. The fixed block 200 shown in FIGS. 10A and 10B includes a guard 1010 attached to the frame. The guard 1010 prevents line or rope 150 from entering the gap 1020 between the knurled surface 216 and the sheave or pulley 212 and the housing 200. The guard 1010 can also be termed a guide that guides the line 150 from entering the gap 1020. The guard 1010, in one embodiment is a metal plate that is welded or otherwise attached to a corner of the housing. The corner is selected so that it prevents the line 150 from entering the gap 1020 when the line is being placed in a locking position with the line pinched between the widened edge 216 and the top inside portion of the housing 200. It is recognized that as the block and tackle is used, the line 150 will wear and have to be replaced. If a user replaces the line 150 with a smaller diameter line and uses the block and tackle as intended, the smaller line may be more prone to jamming in the gap 1020.

It should be noted that the number of sheaves is not limited to two sheaves in the fixed block and two sheaves in the moving block. By increasing the sheaves, the amount of mechanical advantage is increased. More line is needed with an increased number of sheaves in the fixed block or the moving block.

Figure 6:
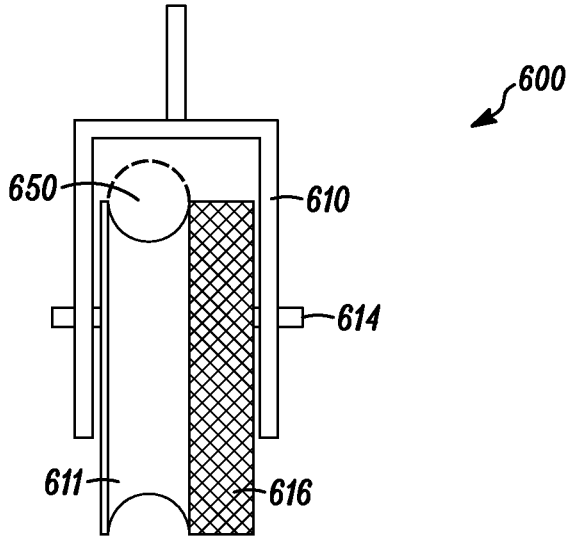
FIG. 6 shows a pulley that incorporates the invention, according to an example embodiment.

It should also be noted that the invention is not required to be used as a block and tackle. FIG. 6 shows a pulley 600 that incorporates the invention. The pulley 600 includes a housing 610. A sheave 611 rotates about an axle 614. The axle is attached to the housing 610. The sheave 611 has a widened edge 616. The sheave also has an opening therein that is off center so that the clearance distance between edge of the sheave 611 and the edge 616 varies with respect to the housing 610. The pulley 600 includes a line 650. One end of the line is attached to a load. The line 650 is also threaded through the sheave 611. The free end of the line can be pulled to apply a force to the load. Moving the line to the side of the sheave having the widened edge 616 and then slowly lowering the load slightly will cause the line 650 to be pinched or caught between the widened edge 616 and the housing 610. The widened edge 616 can be treated to increase friction, such as by knurling the surface 616. Releasing the line 650 is accomplished by applying a force to the line 650 to dislodge the line 650 from the position where it is pinched or caught. The line 650 can then be placed in the sheave 611 to move the load using the pulley 600. In another embodiment, the sheave 611 could be provided with centered opening about which to rotate and a cam could be placed adjacent the sheave 611. Operation of the pulley would be the same.

In summary, a block and tackle includes a housing for one of a fixed block and a moving block, an axle attached to the housing, and a sheave. The sheave includes a widened edge. The sheave has an opening therein which is off center so that the clearance distance between the edge of the sheave and the housing varies as the sheave rotates. The sheave is rotatably attached to the axle. A line passes over the sheave. The line has a free end. The line has a diameter that is larger than the minimum clearance distance between the edge of the sheave and the housing. The line is movable between a first position in the sheave and a second position over the widened edge of the sheave. In one embodiment, the sheave and the widened edge are formed from a single piece of material. The material can be metal or any other suitable material for a particular application as a block and tackle. In some embodiments, the widened edge is provided with a surface treatment to increase friction. The surface treatment in one embodiment includes knurling. The line has a diameter which is slightly less than a distance across the sheave. In one embodiment, the axle is placed at a distance from the top of the housing such that the minimum clearance between the widened edge and the housing is small enough to prevent the movement of the widened edge and the sheave when the line is placed on the widened edge. The movement is prevented when the clearance is at or near the minimum clearance distance. Movement of the sheave is not prevented at all points where the line is placed on the widened edge.

The invention also contemplates a pulley includes a housing, an axle attached to the housing, and a sheave. The sheave further includes a widened edge. The sheave has an opening therein which is off center so that the clearance distance between the edge of the sheave and the housing varies as the sheave rotates. The sheave is rotatably attached to the axle. The pulley also includes a line passing over the sheave. The line has a free end. The line has a diameter that is larger than the minimum clearance distance between the edge of the sheave and the housing. The line is movable between a first position in the sheave and a second position over the widened edge of the sheave. In one embodiment, the sheave and the widened edge are formed from a single piece of material. The material can be metal or any other suitable material for a particular application as a block and tackle. In some embodiments, the widened edge is provided with a surface treatment to increase friction. The surface treatment in one embodiment includes knurling. The line has a diameter which is slightly less than a distance across the sheave. In one embodiment, the axle is placed at a distance from the top of the housing such that the minimum clearance between the widened edge and the housing is small enough to prevent the movement of the widened edge and the sheave when the line is placed on the widened edge. The movement is prevented when the clearance is at or near the minimum clearance distance. Movement of the sheave is not prevented at all points where the line is placed on the widened edge.

The invention also includes a lifting mechanism that includes a housing, an axle attached to the housing, and an element including a cam surface mounted for rotation on the axle. The distance between the cam surface and the housing changes between a maximum clearance distance and a minimum clearance distance as the element rotates about the axle. The lifting mechanism also includes a line which can be moved between a first position over the cam surface and a second position. In one embodiment, the cam surface includes a surface treatment for increasing an amount of friction at the cam surface. In another embodiment, the cam surface is associated with a cam and in still another embodiment, the cam surface is associated with a round element that includes an off center opening. The round element is rotatably mounted to the axis via the off center opening. In still a further embodiment, the lifting mechanism also includes a sheave mounted to the axle. The cam surface and the sheave can be formed from a single piece of material. The cam surface and the sheave can also be separate elements. In one embodiment, the line is in the second position when it is positioned within the sheave. The lifting mechanism, in one embodiment, is made from a metal.

The lifting mechanisms discussed above all operate in much the same manner. Namely, the line is used to lift or move a load. The line can be moved to a cam surface which can be a cam or a round surface mounted off center. The line is released to lower the load and when the line is on the cam surface it catches or is gripped as the cam surface goes toward the position with respect to the housing where the clearance distance is minimum. The load can be held without having to tie off the free end of the line. Of course, some users are cautious and would also tie off the line. The line can be released by tugging or applying a force to the line to lift or move the load. The line is moved to a second position off the camming surface. In some embodiments, this is a position within a sheave. When in the sheave, the lifting mechanism can be operated without the line catching or interfering with the housing. The lifting mechanism can be a block and tackle or can be a pulley.

The same mechanism can be used in situations where there is a substantial horizontal component of force to overcome. In these situations, the mechanism will lock a rope, line or cord in place even though the force may include a substantial portion which is not due to gravity. The mechanism can therefore be termed a locking mechanism which can be used to overcome the force of gravity or other forces that include a substantial horizontal component. The locking mechanism can hold a rope, line or cord when any force is present resulting in tension on the line, rope or cord. The tension force can be due to gravity, another vertical force, or a horizontal force, or a mixture of vertical and horizontal forces. The locking mechanism will hold the line, rope or cord in each instance. The locking mechanism includes a housing and an axle attached to the housing, and a sheave that is attached to the axle so that the sheave rotates with respect to the housing. The sheave has a widened edge. In one embodiment, the sheave has an opening therein which is off center so that a clearance distance between the edge of the sheave and the housing varies between a minimum and maximum clearance distance as the sheave rotates. The locking mechanism also includes a line. The line has a diameter that is smaller than the maximum clearance distance and larger than the minimum clearance distance. The line passes over the sheave. The line is movable between a first position in the sheave and a second position over the widened edge of the sheave. The line is brought into a locking position as tension is applied to one end of the line when the line is brought into the second position. After the line is brought to a second position over the widened portion of the sheave, the counterforce on the line is released allowing the line to be pinched or gripped between the widened edge and the housing. Releasing the line is accomplished by pulling the free end to move the pulley or sheave in a direction away from the housing. The line can then be moved onto the sheave and the locking mechanism can be used as a pulley alone or as part of a block and tackle. The widened edge can be provided with a surface treatment to roughen the surface and increase the friction between the line and the widened edge. In another embodiment, the housing portion that grips or pinches the rope can also be provided with features or a surface treatment for increasing the friction on the line. In one embodiment, both the housing and the widened edge are provided with a surface treatment. One surface treatment can include knurling. In another embodiment, one or both of the housing and the widened edge can be provided with features, such as ridges, for enhancing the ability of the widened edge or housing to grip the line. In some embodiments, these could be cast or machined into the housing or widened edge. In other embodiments, one of the housing or the widened edge is provided with a first surface treatment and the other is provided with a second surface treatment or set of features.

Figure 7:
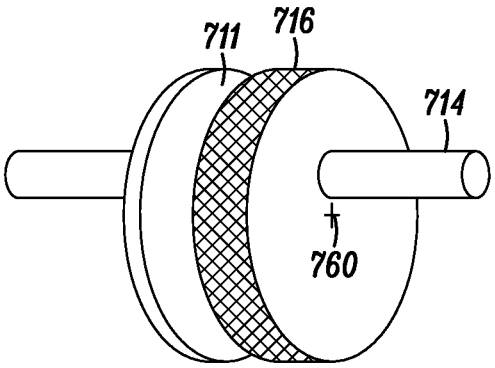
FIG. 7 shows a pulley or sheave with an axle attached at a location offset from a central axis, according to an example embodiment.

As discussed above, the sheave is provided with an opening that receives an axle. FIG. 7 shows another example embodiment in which an axle 714 is attached to the pulley or sheave 711 at a location offset from a central axis 760. As shown, the axle 714 can be mounted directly to the sheave 711 and then the sheave and axle assembly can rotate within a set of openings in the housing. The sheave 711 also includes a widened edge 716.

The lifting mechanism or locking mechanism has wide application. This can be used by outdoorsman to hoist big game, or by a homeowner wanting to store items near the ceiling of a garage. These are but two examples. The number of uses is seemingly endless. This device is especially helpful to a weaker user who would have trouble tying off a free end of a line while maintaining tension in the free end. Other uses include: a flower pot hanger, a rifle and bow hoist, a tree stand hoist, an RV (recreational vehicle) tie-down, an aircraft tie-down, an extension ladder assembly, an automatic big game feeder (to raise and lower the feeder), a birdhouse (raising and lowering), sailboat rigging, a boat anchor, a venetian blind, a painter/window washer hoist, a backpack tie-down, rock climbing gear, a tarp tie-down, a camping tent tie-down, and for farm gear, such as for a barb wire fence stretcher. Of course, this list is not exhaustive as there are many more uses for the lifting mechanism or locking mechanism discussed in detail above.

This has been a detailed description of some exemplary embodiments of the invention(s) contained within the disclosed subject matter. Such invention(s) may be referred to, individually and/or collectively, herein by the term "invention" merely for convenience and without intending to limit the scope of this application to any single invention or inventive concept if more than one is in fact disclosed. The detailed description refers to the accompanying drawings that form a part hereof and which shows by way of illustration, but not of limitation, some specific embodiments of the invention, including a preferred embodiment. These embodiments are described in sufficient detail to enable those of ordinary skill in the art to understand and implement the inventive subject matter. Other embodiments may be utilized and changes may be made without departing from the scope of the inventive subject matter. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

I claim:

1. A pulley comprising:

a housing;

an axle attached to the housing;

a sheave, the sheave further comprising a widened edge, the sheave having an opening therein which is off center so that a clearance distance between the widened edge of the sheave and the housing varies as the sheave rotates, the sheave rotatably attached to the axle; and a line passing over the sheave having a free end, the line having a diameter that is larger than a minimum clearance distance between the widened edge of the sheave and the housing, the line being movable between a first position in the sheave and a second position over the widened edge of the sheave.

2. The pulley of claim 1 wherein the axle defines a rotation axis for the sheave, the widened edge having a circular cross section in a plane perpendicular to the rotation axis, and the axle and the rotation axis being offset from a geometric center of the widened edge.

3. The pulley of claim 1 wherein the widened edge is provided with a surface treatment to increase friction.

4. The pulley of claim 1 wherein the widened edge includes a knurled surface.

5. The pulley of claim 1 wherein the line has a diameter which is slightly less than a distance across the sheave.

6. The pulley of claim 1 wherein the axle is placed at a distance from a top of the housing such that the minimum clearance between the widened edge and the housing is small enough to prevent the movement of the widened edge and the sheave when the line is placed on the widened edge.

7. A lifting mechanism comprising:

a housing;

an axle attached to the housing and defining a rotation axis;

a round element including a cam surface and an off center opening, the round element being mounted to the axle via the off center opening and being rotatable about the rotation axis relative to the housing, a distance between the cam surface and the housing changing between a maximum clearance distance and a minimum clearance distance as the element rotates about the rotation axis, wherein the cam surface has a circular cross-section in a plane perpendicular to the rotation axis; and a line which can be moved between a first position over the cam surface and a second position.

8. The lifting mechanism of claim 7 wherein the cam surface includes a surface treatment for increasing an amount of friction at the cam surface.

9. The lifting mechanism of claim 7 further comprising a sheave mounted to the axle.

10. The lifting mechanism of claim 9 wherein the cam surface and the sheave are formed from a single piece of material.

11. The lifting mechanism of claim 9 wherein the line is in the second position when it is positioned within the sheave.

12. The lifting mechanism of claim 7 wherein the lifting mechanism is made from a metal.

13. A locking mechanism comprising:

a housing;

an axle attached to the housing;

a sheave, the sheave further comprising a widened edge, the sheave having an opening therein which is off center so that a clearance distance between the edge of the sheave and the housing varies between a minimum and maximum clearance distance as the sheave rotates, the sheave rotatably attached to the axle; and a line passing over the sheave, the line having a diameter that is smaller than the maximum clearance distance and larger than the minimum clearance distance, the line movable between a first position in the sheave and a second position over the widened edge of the sheave, wherein the line is brought into a locking position as tension is applied to one end of the line when the line is brought into the second position.

14. The locking mechanism of claim 13 wherein the sheave and the widened edge are formed from a single piece of material.

15. The locking mechanism of claim 13 wherein the widened edge is provided with a surface treatment to increase friction.

16. The locking mechanism of claim 13 wherein the widened edge includes a knurled surface.

17. The locking mechanism of claim 13 wherein the line has a diameter which is slightly less than a distance across the sheave.

18. The locking mechanism of claim 13 wherein the axle is placed at a distance from a top of the housing such that the minimum clearance between the widened edge and the housing is small enough to prevent the movement of the widened edge and the sheave when the line is placed on the widened edge.

* * * * *